US007367786B2

(12) United States Patent
Kang et al.

(10) Patent No.: US 7,367,786 B2
(45) Date of Patent: May 6, 2008

(54) LINEAR COMPRESSOR

(75) Inventors: Jeong-hoon Kang, Seoul (KR); Jae-man Joo, Gyeonggi-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 618 days.

(21) Appl. No.: 10/813,162

(22) Filed: Mar. 31, 2004

(65) Prior Publication Data

US 2005/0135946 A1 Jun. 23, 2005

(30) Foreign Application Priority Data

Dec. 18, 2003 (KR) ..... 10-2003-0092796

(51) Int. Cl.
*F04B 31/00* (2006.01)

(52) U.S. Cl. ..... 417/417

(58) Field of Classification Search ..... 417/415, 417/416, 417, 269

See application file for complete search history.

(56) References Cited

U.S. PATENT DOCUMENTS 5,211,372 A * 5/1993 Smith, Jr. ..... 251/75
5,255,521 A * 10/1993 Watanabe ..... 62/6
5,920,133 A * 7/1999 Penswick et al. ..... 310/17
5,993,178 A * 11/1999 Park et al. ..... 417/545
6,056,519 A * 5/2000 Morita et al. ..... 417/415
2004/0251748 A1* 12/2004 Inagaki et al. ..... 310/14

FOREIGN PATENT DOCUMENTS

JP 2950793 7/1999

* cited by examiner

*Primary Examiner*—Anthony Stashick
*Assistant Examiner*—Vikansha Dwivedi
(74) *Attorney, Agent, or Firm*—Sughrue Mion, PLLC

(57) ABSTRACT

A linear compressor includes: a cylinder block forming a compressing chamber; a piston reciprocatably provided in the compressing chamber; a reciprocating member connected to the piston to reciprocate with the piston as a single body; a driver driving the reciprocating member to reciprocate; and a resonance spring including a first connecting part formed with a plurality of first connecting holes to permit connection to the cylinder block, and a second connecting part that is provided inside of the first connecting part and formed with a second connecting hole to permit connection to the reciprocating member to reciprocate with the reciprocating member. A plurality of arms spaced apart from one another are disposed between the first connecting part and the second connecting part, each of the arms including a first end connected to the first connecting part to be positioned between the plurality of first connecting holes.

13 Claims, 5 Drawing Sheets

LINEAR COMPRESSOR

CROSS-REFERENCE TO RELATED APPLICATIONS

This application claims the benefit of Korean Patent Application No. 2003-092796, filed on Dec. 18, 2003, in the Korean Intellectual Property Office, the disclosure of which is incorporated herein by reference.

BACKGROUND OF THE INVENTION

1. Field of the Invention

An apparatus consistent with the present invention relates to a linear compressor and, more particularly, to a linear compressor having a resonance spring of an improved structure.

2. Description of the Related Art

Generally, different from a reciprocating compressor, a linear compressor is of a free-piston structure having no connecting rod to restrict movement of a piston. The linear compressor comprises an outer casing to seal a predetermined space, a compressing part accommodated in the outer casing to suck and compress/discharge refrigerant gas and a driver to operate the compressing part by electric power from the outside.

The compressing part comprises a cylinder block forming the compressing chamber, a piston reciprocatably provided in the compressing chamber and a cylinder head having a sucking valve to suck a refrigerant gas in the compressing chamber and a discharging valve to discharge the refrigerant gas.

The driver comprises an inner core provided outside of the cylinder block, an outer core spaced apart from a circumferential surface of the inner core, a magnet provided between the outer core and the inner core to reciprocate in a perpendicular direction by interacting with a magnetic field generated between the inner and outer cores due to electric power from the outside. A reciprocating member having a first part connected with an upper part of the piston and a second part connected to the magnet of the driver is provided on the compressing part to reciprocate with the piston and the magnet as a single body. A resonance spring connected with reciprocating member and the outer core of the driver is provided on the reciprocating member to facilitate a reciprocation of the piston.

Generally, the reciprocation of the piston depends on a stiffness due to the gas pressure in the compressing chamber, a stiffness of the resonance spring, the weight of the piston and a driving force of the driver.

The stiffness of the gas pressure in the compressing chamber is reduced when the discharging valve is opened. That is, if the stiffness of the gas pressure in the compressing chamber is increased when the refrigeration gas is compressed and reduced when the refrigeration gas is discharged. An average stiffness with respect to the average gas pressure in the compressing chamber has a highly nonlinear property as the maximum displacement of the piston is varied.

The stiffness of the resonance spring may be represented as an elastic force of the resonance spring per a unit displacement.

If the weight of the piston and the driving force of the driver are constant, the reciprocating motion of the piston mainly depends on the stiffness of the resonance spring and the stiffness or resistance of the gas pressure in the compressing chamber. The stiffness of the resonance spring and the resistance of the gas pressure in the compressing chamber facilitate the efficient operation of the linear compressor. For greater efficiency, it is better if a natural frequency according to the addition of the stiffness of the resonance spring and the average stiffness with respect to the gas pressure remains approximately the same as a frequency of the electric power.

As shown in FIG. 1, the conventional resonance spring 150 is of a disk shape and comprises a first connecting part 151 connected with the outer core (not shown) at a circumferential part and a second connecting part 155 connected with the reciprocating member (not shown) in the center to reciprocate with the reciprocating member as a single body. The resonance spring 150 is formed with a plurality of through holes 159 of a spiral shape between the first connecting part 151 and the second connecting part 155, which forms a plurality of arms 160.

The first connecting part 151 is formed with a plurality of first connecting holes 153 so as to be fixedly connected with the outer core by bolts passing therethrough and the second connecting part 155 is provided with a second connecting hole 157 to permit connection with the reciprocating member by a bolt passing therethrough.

Thus, the first connecting part 151 of the conventional resonance spring 150 is fixed with the outer core of the driver and the second connecting part 155 thereof is reciprocatably connected with the reciprocating member, which facilitates the reciprocation of the piston.

However, the first connecting holes 153 of the conventional linear compressor are formed also at a part at which the first connecting part 151 and the arm 160 are connected. Thus, the first connecting part 151 is not deformed with respect to the outer core of the driver, when the reciprocating member reciprocates. In the conventional linear compressor, only the second connecting part 155 is twisted—deformed with respect to the first connecting part 151. Accordingly, the stiffness of the conventional resonance spring 150 has an approximately linear property, so that the stiffness is approximate linearly changed as the maximum displacement is changed.

As shown in FIG. 2, the average stiffness or resistance b of the gas pressure constantly decreases in a narrow-range for maximum displacement at a small displacement section X1, and radically decreases highly nonlinearly for maximum displacement at a large displacement section X2. The stiffness a of the conventional spring remains constant and has an approximately linear property in both the small displacement section X1 and the large displacement section X2.

Thus, an addition c of the stiffness a of the conventional spring and the average stiffness b of the gas pressure remains fairly constant in the small displacement section X1 but still radically decreases in the large displacement section X2.

Accordingly, the conventional linear compressor can be used only in the small displacement section X1 in which the addition c of the stiffness a of the conventional spring and the average stiffness b of the gas pressure remains fairly constant and approximately the same as the frequency of the electric power, thereby causing a problem in that the conventional linear compressor cannot be used in the large displacement section X2 in which the average stiffness of the gas pressure is radically changed with a highly nonlinear property.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

Accordingly, it is an aspect of the present invention to provide a linear compressor usable also in a large displacement section in which a stiffness of a gas pressure in a compressing chamber is radically decreased.

Additional aspects and/or advantages of the invention will be set forth in part in the description which follows and, in part, will be understood from the description, or may be learned by practice of the invention.

The foregoing and/or other aspects of the present invention are also achieved by providing a linear compressor comprising: a cylinder block forming a compressing chamber; a piston reciprocatably provided in the compressing chamber; a reciprocating member connected to the piston to reciprocate with the piston as a single body; a driver driving the reciprocating member to reciprocate; and a resonance spring comprising a first connecting part formed with a plurality of first connecting holes to permit connection to the cylinder block, a second connecting part that is provided inside of the first connecting part and formed with a second connecting hole to permit connection to the reciprocating member to reciprocate with the reciprocating member as a single body, and a plurality of arms spaced apart from one another between the first connecting part and the second connecting part, each of the arms comprising a first end connected to the first connecting part to be positioned between the plurality of first connecting holes, a second end connected to the second connecting part to be positioned in the vicinity of the second connecting part, and a plurality of arm bodies of a spiral shape to connect the first end and the second end.

According to an aspect of the invention, a width of the first connecting part is in a range of approximately one half a width of the arm body and three times the width of the arm body.

According to an aspect of the invention, the distance between the first connecting part and each of the arm bodies is in a range of approximately one half the width of the arm body and three times the width of the arm body.

According to an aspect of the invention, the width of the first connecting part is increased from the first end of the arm along a direction of the arm body.

According to an aspect of the invention, a first groove is inwardly formed on an outer circumference of the first connecting part in a vicinity of the first end of each of the arms.

According to an aspect of the invention, a second groove is outwardly formed on an inner circumference of the first connecting part in the vicinity of the first end.

According to an aspect of the invention, the number of the arms is identical with the number of the first connecting holes.

According to an aspect of the invention, the arms and the first connecting holes are provided three in number at equal intervals, respectively.

According to an aspect of the invention, the resonance spring is of a disk shape.

According to an aspect of the invention, the driver comprises an outer core connected to the cylinder block, an inner core provided inside of the outer core and spaced apart from the outer core and a magnet provided between the outer core and the inner core to reciprocate by a magnetic field generated between the outer core and the inner core, and the magnet reciprocates with the reciprocating member as a single body and the outer core is connected with the first connecting hole of the first connecting part.

BRIEF DESCRIPTION OF THE DRAWINGS

The above and other aspects and/or advantages of the present invention will become apparent and more readily appreciated from the following description of illustrative, non-limiting embodiments, taken in conjunction with the accompanying drawings, in which.

DETAILED DESCRIPTION OF ILLUSTRATIVE, NON-LIMITING EMBODIMENTS OF THE INVENTION

Figure 1:
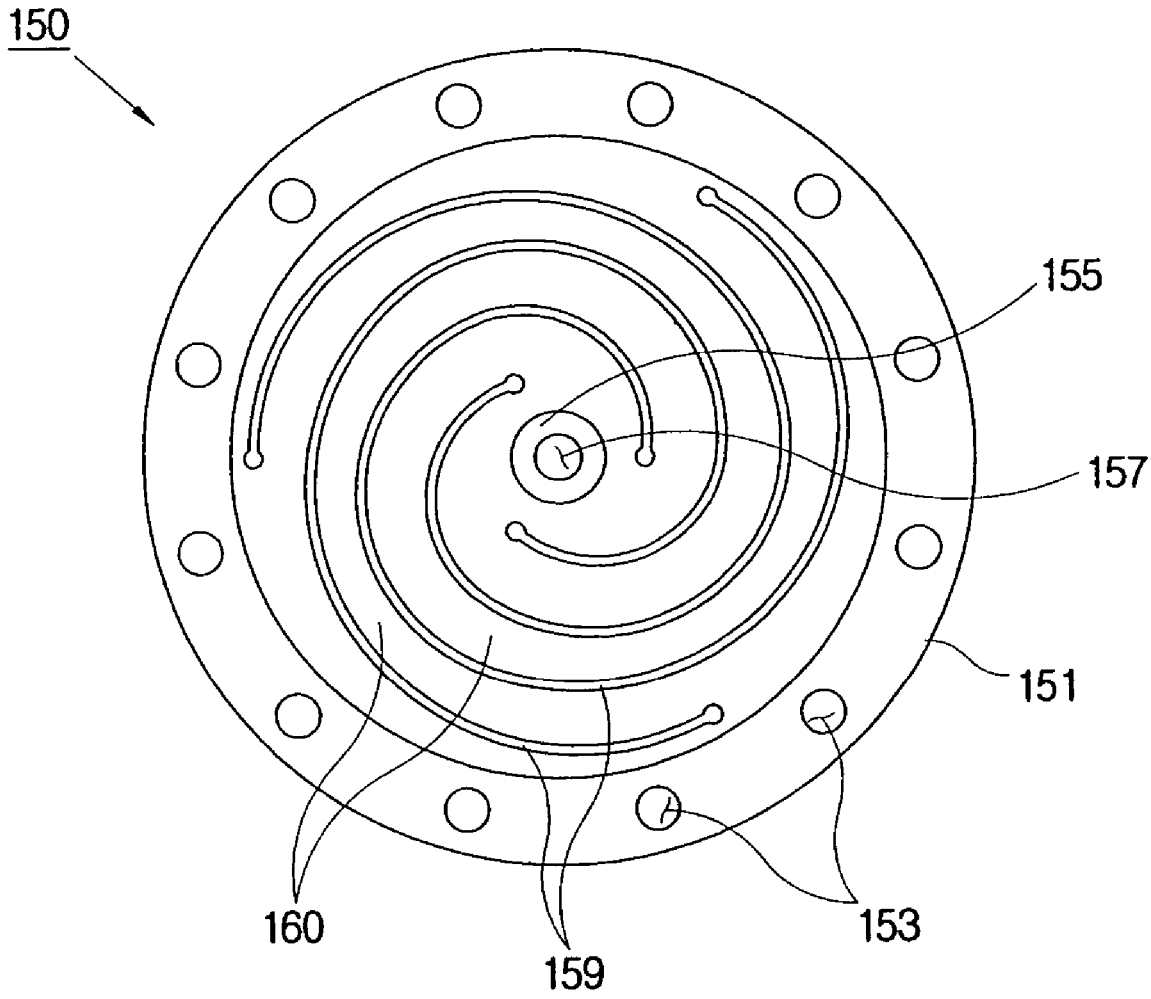
FIG. 1 (PRIOR ART)
FIG. 1 is a front view of a resonance spring used for a conventional linear compressor.
Figure 2:
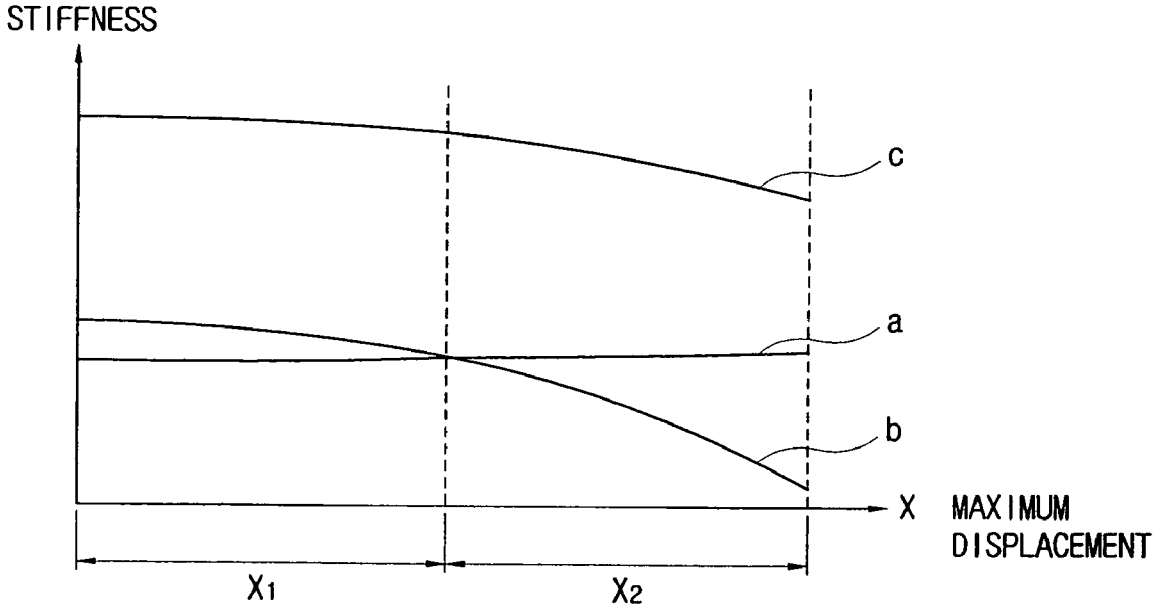
FIG. 2 (PRIOR ART)
FIG. 2 is a graph showing a change of an average stiffness with respect to a gas pressure and a stiffness of the resonance spring according to a maximum displacement of the piston in the conventional linear compressor.

Reference will now be made in detail to illustrative, non-limiting embodiments of the present invention, examples of which are illustrated in the accompanying drawings, wherein like reference numerals refer to like elements throughout. The exemplary embodiments are described below in order to explain the present invention by referring to the figures.

Figure 3:
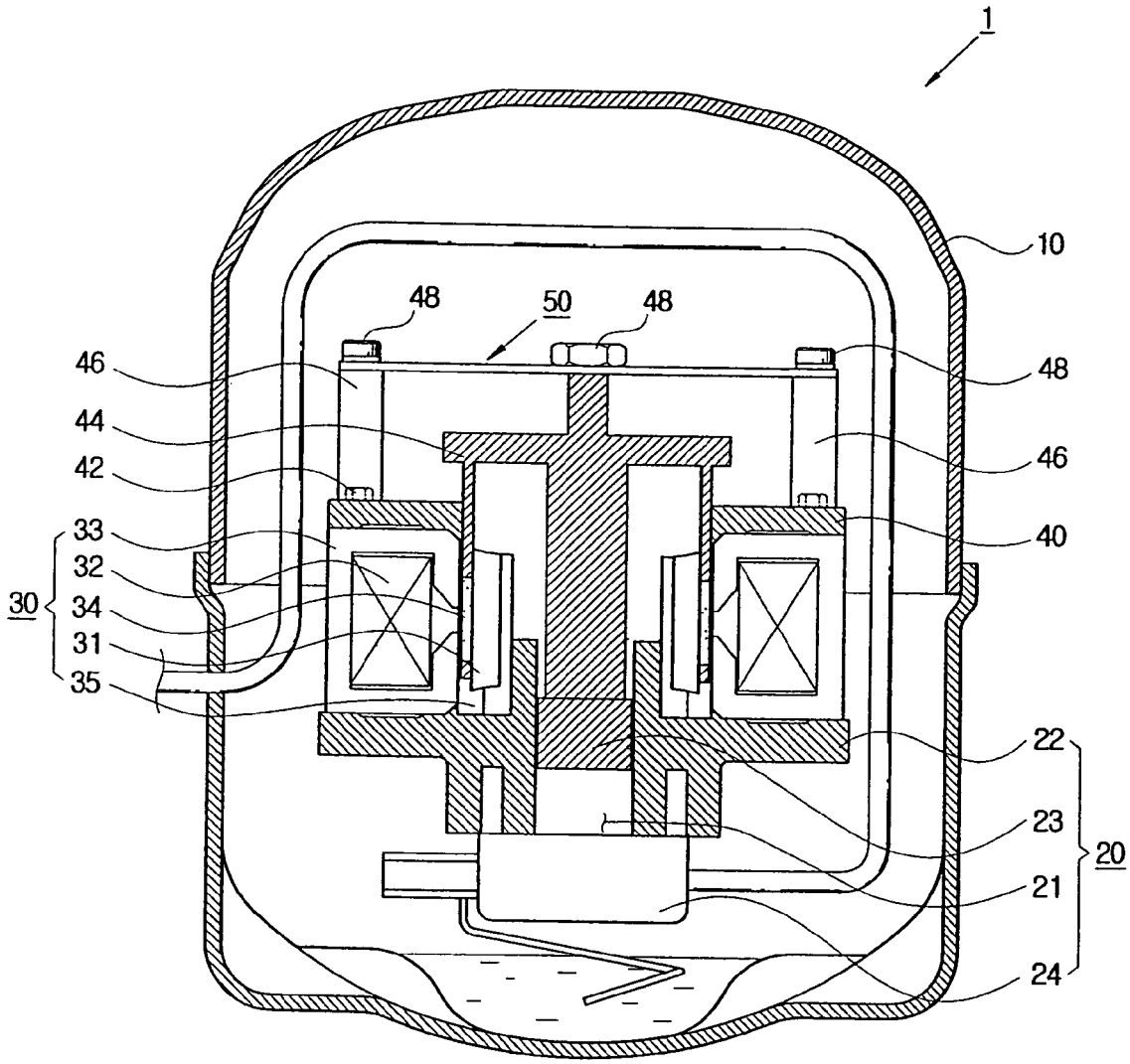
FIG. 3 is a vertical sectional view of a linear compressor according to an exemplary embodiment of the present invention.

As shown in FIG. 3, a linear compressor 1 according to an embodiment of the present invention comprises a sealed outer casing 10, a compressing part 20 for sucking refrigerant gas to compress and discharge the refrigerant gas and a driver 30 to operate the compressing part 20.

The compressing part 20 comprises a cylinder block 22 to support a bottom of an outer core 33 (to be described later) of the driver 20 and to form a compressing chamber 21, a piston 23 reciprocatably provided in the compressing chamber 21 and a cylinder head 24 provided under the cylinder block 22 and comprising a sucking valve (not shown) and a discharging valve (not shown) to suck and discharge the refrigerant gas, respectively.

The driver 30 comprises an inner core 31 provided outside of the cylinder block 22, the outer core 33 provided outside of the inner core 31 and having the inside wound by a coil 32 of a ring shape, a magnet 34 provided between the outer core 33 and the inner core 31 to reciprocate in a perpendicular direction by interacting with magnetic fields around the inner and outer cores 31 and 33 and an inner core supporter 35 provided between the inner core 31 and the cylinder block 22 to support the inner core 31.

The outer core 33 has a top and a bottom supported by a holder 40 and the cylinder block 22, respectively. The outer core 33 is stacked with a plurality of core steel sheets. The stacked steel sheets are penetrated by a plurality of core connecting bolts 42 that are spaced apart from a circumferential surface of the outer core 33 and provided at predetermined intervals, which connects the stacked steel sheets with the holder 40 and the cylinder block 22.

A reciprocating member 44 connected with the magnet 34 of the driver 30 and the piston 23 as a single body is provided on the compressing part 20. The reciprocating member 44 reciprocates the piston 23 inside the compressing chamber 21 by reciprocation of the magnet 34.

A resonance spring 50 is provided above the reciprocating member 44 and the holder 40 to facilitate the reciprocation of the piston 23. A plurality of spring spacers 46 connected with a top of the holder 40 and a first connecting part 51 of the resonance spring 50 (to be described later) are provided between the holder 40 and the resonance spring 50.

Figure 4:
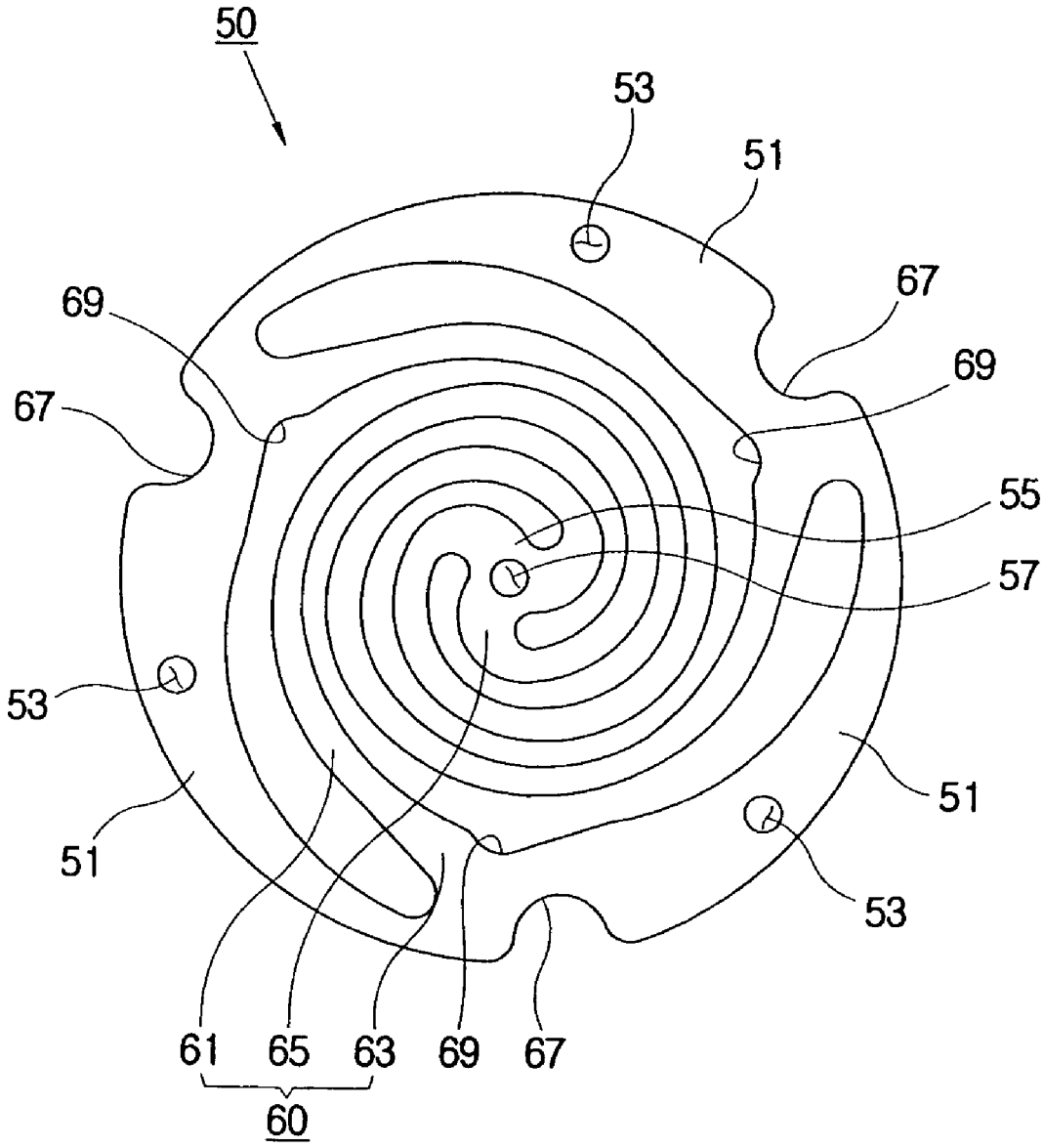
FIG. 4 is a front view of a resonance spring used for the linear compressor according to the exemplary embodiment of the present invention.
Figure 5:
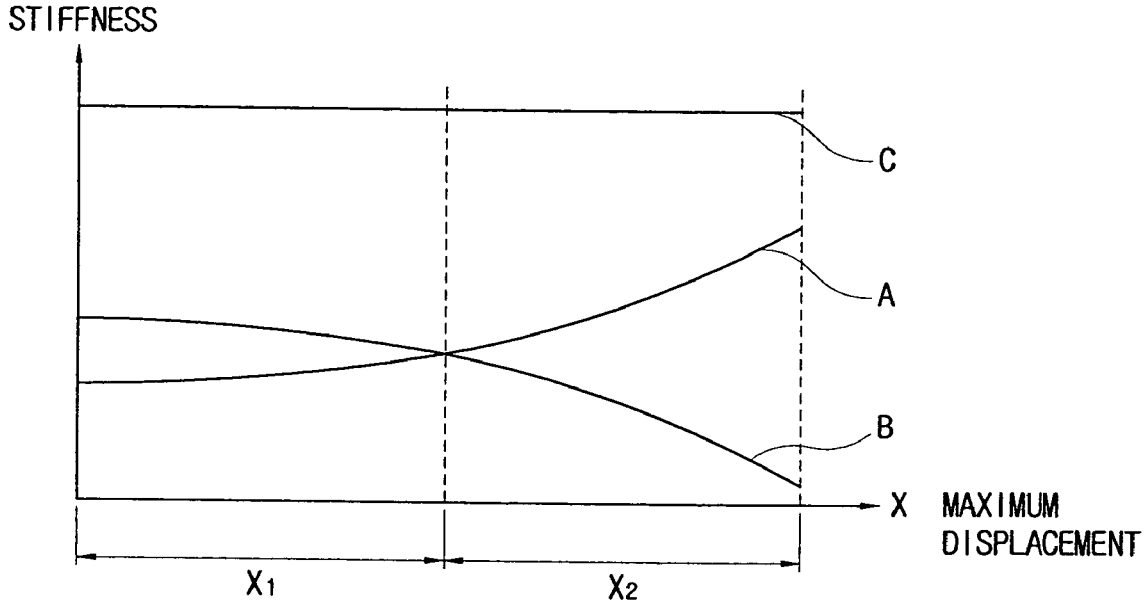
FIG. 5 is a graph showing a change of an average stiffness with respect to a gas pressure and a stiffness of the resonance spring according to a maximum displacement of the piston in the linear compressor according to the exemplary embodiment of the present invention.

As shown in FIG. 4, the resonance spring 50 comprises the first connecting part 51 with a plurality of connecting holes 53 to permit connection by, for example, bolts 48 (see FIG. 3) with the cylinder block 22, a second connecting part 55 having a second connecting hole 57 that is provided inside of the first connecting part 51 to permit connection by, for example, bolt 48 (see FIG. 3) with the reciprocating member 44 and reciprocate with the reciprocating member 44 as a single body, and a plurality of arms 60 spaced apart from one another and provided between the first connecting part 51 and the second connecting part 55. According to an aspect of the present invention, the resonance spring 50 is of a disk shape, but is not limited thereto. For example, the resonance spring 50 may be polygonal to comprise the first connecting part 50 and the second connecting part 55.

Each of the arms 60 comprises a first end 63 connected with the first connecting part 51 to be positioned between the plurality of first connecting holes 53, a second end 65 in the vicinity of the second connecting hole 57 to be connected with the second connecting part 55, and an arm body 61 of a spiral shape connecting the first end 63 and the second end 65. The number of arms 60 may be the same as that of the number of the first connecting holes 53. For example, if the resonance spring 50 comprises three of the first connecting holes 53, then three arms 60 may be provided. The arms 60 may be spaced at equal intervals with respect to each other. Thus, the arm body 61 is bending-deformed with respect to the first connecting part 51 in a reciprocating direction of the reciprocating member 44; and the part of the first connecting part 51 connected to the first end 63 of each of the arms 60 is twisted-deformed with respect to the first connecting hole 53; since the first end 63 of each of the arms 60 is connected with the first connecting part 51 to be positioned between the plurality of first connecting holes 53, if the second connecting part 55 reciprocates due to the reciprocating member 44.

The first end 63 of each of the arms 60 is provided between the first connecting holes 53 so as not to be positioned in the vicinity of the first connecting hole 53. As an aspect of the present invention, the first end 63 of each of the arms 60 may be connected to the first connecting part 51 at a position approximately halfway between an adjacent pair of the first connecting holes 53.

The arm body 61 is of a spiral shape that is formed from the first end 63 to the second end 65 along a direction of an increase of the width of the first connecting part 51. According to an aspect of the present invention, the distance between each of the arm bodies 61 may be in a range of approximately one half the width of the arm body 61 and three times the width of the arm body 61. For example but not by way of limitation, the distance between each of the arm bodies 61 may be approximately the same as the width of the arm body 61. The nearer the arm bodies 61 are to each other, the wider the width of each of the arm bodies 61 becomes. Thus, load is uniformly distributed on the arm body 61 when the second connecting part 55 reciprocates by the reciprocating member 44.

The first connecting part is provided at an outer part of the resonance spring 50 with a predetermined width. The plurality of first connecting holes 53 may be connected to a top of each of the spring spacers 46 by, for example, bolts 48. The plurality of first connecting holes 53 may be positioned at equal intervals. The first connecting holes 53 may be provided three in number and each of the three first connecting holes 53 forms 120 degree with one another, but is not limited thereto. The number of first connecting holes 53 may be 2, or 4, or more than 4. The width of the first connecting part 51 may be in a range of approximately one half to three times as wide as the width of the arm body 61. The width of each of the first connecting part 51 may be increased from the first end 63 in a direction of forming of the arm body 61. An outer circumference of each of the first connecting parts 51 in the vicinity of the first end 63 of arm 60 may be formed with a first groove 67 grooved inwardly toward the second connecting hole 57. An inner circumference of the first connecting part 51 near or in the vicinity of the first groove 67 is formed with a second groove 69 grooved in a radial direction.

The first groove 67 prevents a radical increase in the width of the first connecting part 51 connected with the first end 63 of the arm 60. The depth of the first groove 67 may be half as deep as the width of the first connecting parts 51 but is not limited thereto, which may be varied according to a stiffness required for the resonance spring 50. Thus, the part of the first connecting part 51 connected with the first end 63 of the arm 60 may be more easily twisted-deformed with respect to the first connecting hole 53 due to the first groove 67. Further, the radical increase in the width of the first connecting part 51 connected with the first end 63 of the arm 60 is prevented, which decreases a concentration of the stress on the first end 63, thereby prolonging life of the resonance spring 50 and increasing a reliability of the product.

A detailed description of the second groove 69 is omitted, because the second groove 69 is applied for the same purpose of the first groove 67. In the exemplary embodiment of the present invention described above, both of the first and second grooves 67 and 69 are provided, but limited thereto. Only one of the first and second grooves 67 and 69 may be provided.

The reciprocating motion of the piston 23 depends on the stiffness of the resonance spring 50, the stiffness of the gas pressure in the compressing chamber 21, the weight of the piston 23 and a driving force of the driver 30. If the weight of the piston 23 and the driving force of the driver 30 remains approximately constant, the reciprocating motion of the piston 23 mainly depends on the stiffness of the resonance spring 50 and the stiffness of the gas pressure in the compressing chamber 21. The stiffness of the gas pressure in the compressing chamber 21 is increased when the refrigerant gas is compressed and reduced when the refrigerant gas is discharged. A stiffness corresponding to an average gas pressure in an entire displacement section of the piston 23 is defined as an average stiffness B. The average stiffness B is decreased having highly nonlinear property as the maximum displacement of the piston 23 is increased. That is, the average stiffness B remains almost constant in a small displacement section X1 with a small maximum displacement of the piston 23 and is radically decreased having a highly nonlinear property in a large displacement section X2 with a large maximum displacement of the piston 23.

The stiffness A of the resonance spring 50 may be represented as an elastic force of the resonance spring 50 per a unit displacement. Due to the bending-deformation of the arm body 61 and the twisted-deformation of the first connecting part 51, the stiffness A of the resonance spring 50 has a nonlinear property. The stiffness A of the resonance spring 50 remains almost constant in a small displacement section X1 with a small maximum displacement of the piston 23 and is radically increased having a highly nonlinear property in a large displacement section X2 with a large maximum displacement of the piston 23. Thus, the increase of the stiffness A of the resonance spring 50 compensates for the decrease of the average stiffness B with respect to the gas pressure in the large displacement section X2.

Accordingly, an addition C of the stiffness A of the resonance spring 50 and the average stiffness B of the gas pressure remains approximately constant not only in the small displacement section X1, but also in the large displacement section X2. A natural frequency according to the addition C of the stiffness A of the resonance spring 50 and the average stiffness B of the gas pressure in the small displacement section X1 and the large displacement section X2 thus remains approximately the same as an electric power frequency of the driver 30. Thus, the reciprocating motion of the piston 23 may be facilitated, which increases an efficiency of the driver 30.

According to a configuration described above, the linear compressor according to the exemplary embodiment of the present invention operates as follows.

If electric power is supplied to the coil 32 of the outer core 33, magnetic field therearound is interacted with the magnetic field by the magnet 34 connected to the reciprocating member 44, which reciprocates the piston 23 in a perpendicular direction.

If the piston 23 reciprocates, the refrigerant gas is sucked in the compressing chamber 21 through the sucking valve repeatedly to be compressed and discharged, thereby the refrigerant gas is refrigerated as required.

In this case, in the large displacement section X2 in which the average stiffness B of the gas pressure is radically decreased, the natural frequency of the resonance spring 50 is approximately identical with the frequency of the supplied electric power. Thus, the efficiency of the driver 30 is increased due to a resonance, thereby saving consumption power.

Like this, the linear compressor according to the exemplary embodiment of the present invention comprises the resonance spring in which the first end of each of the arms is connected to the first connecting part positioned between the plurality of connecting holes. Thus, when the reciprocating member reciprocates the second connecting part, the arm body is bending-deformed and the first connecting part is the twisted-deformed, so that the linear compressor can be used also in the large displacement section in which the stiffness of the gas pressure is radically decreased.

As described above, at least one of the first groove and the second is formed in the first connecting part of the resonance spring, which prevents a radical increase in the width of the first connecting part connected with the first end. Thus, the concentration of the stress is decreased and life of the resonance spring is prolonged, thereby providing for reliability.

As described above, the present invention provides the resonance spring usable also in the large displacement section in which the stiffness of the gas pressure is radically increased.

Further, at least one of the first groove and the second is formed, which decreases the concentration of the stress.

Although exemplary embodiments of the present invention have been shown and described, it will be appreciated by those skilled in the art that changes may be made in these exemplary embodiments without departing from the principles and spirit of the invention, the scope of which is defined in the appended claims.

What is claimed is:

1. A linear compressor comprising:

a cylinder block forming a compressing chamber;

a piston reciprocatably provided in the compressing chamber;

a reciprocating member connected to the piston to reciprocate with the piston as a single body;

a driver driving the reciprocating member to reciprocate; and a resonance spring comprising a first connecting part formed with a plurality of first connecting holes to permit connection to the cylinder block, a second connecting part that is provided inside of the first connecting part and formed with a second connecting hole to permit connection to the reciprocating member to reciprocate with the reciprocating member as a single body, and a plurality of arms spaced apart from one another between the first connecting part and the second connecting part, each of the arms comprising a first end connected to the first connecting part to be positioned between the plurality of first connecting holes, a second end connected to the second connecting part to be positioned in the vicinity of the second connecting part, and a plurality of arm bodies of a spiral shape to connect the first end and the second end;

wherein a width of the first connecting part is in a range of approximately one half a width of the arm body and three times the width of the arm body, and wherein the width of the first connecting pad is increased from the first end in a direction of forming of each of the arms, to a portion adjacent to an inward groove.

2. The linear compressor according to claim 1, wherein the distance between the first connecting part and each of the arm bodies is in a range of approximately one half the width of the arm body and three times the width of the arm body.

3. The linear compressor according to claim 2, wherein the width of the first connecting part is increased from the first end of the arm along a direction of the arm body.

4. The linear compressor according to claim 3, wherein a first groove is inwardly formed on an outer circumference of the first connecting part in a vicinity of the first end of each of the arms.

5. The linear compressor according to claim 4, wherein a second groove is outwardly formed on an inner circumference of the first connecting part in a vicinity of the first end.

6. The linear compressor according to claim 1, wherein the number of the arms is identical with the number of the first connecting holes.

7. The linear compressor according to claim 6, wherein the arms and the first connecting holes are provided three in number at equal intervals, respectively.

8. The linear compressor according to claim 2, wherein the number of the arms is identical with the number of the first connecting holes.

9. The linear compressor according to claim 8, wherein the arms and the first connecting holes are provided three in number at equal intervals, respectively.

10. The linear compressor according to claim 4, wherein the number of the arms is identical with the number of the first connecting holes.

11. The linear compressor according to claim 10, wherein the arms and the first connecting holes are provided three in number at equal intervals, respectively.

12. The linear compressor according to claim 1, wherein the resonance spring is of a disk shape.

13. The linear compressor according to claim 1, wherein the driver comprises an outer core connected to the cylinder block, an inner core provided inside of the outer core and spaced apart from the outer core and a magnet provided between the outer core and the inner core to reciprocate by a magnetic field generated between the outer core and the inner core, and the magnet reciprocates with the reciprocating member as a single body and the outer core is connected with the first connecting hole of the first connecting part.

* * * * *